US009850778B2

(12) United States Patent
Riggs et al.

(10) Patent No.: US 9,850,778 B2
(45) Date of Patent: Dec. 26, 2017

(54) THERMAL BARRIER COATING WITH CONTROLLED DEFECT ARCHITECTURE

(71) Applicants: Walter L. Riggs, Rural Hall, NC (US); Gunnar W. Swanson, East Bend, NC (US); Heiko Lammers, Merzen (DE)

(72) Inventors: Walter L. Riggs, Rural Hall, NC (US); Gunnar W. Swanson, East Bend, NC (US); Heiko Lammers, Merzen (DE)

(73) Assignee: Siemens Energy, Inc., Orlando, FL (US)

( * ) Notice: Subject to any disclaimer, the term of this patent is extended or adjusted under 35 U.S.C. 154(b) by 697 days.

(21) Appl. No.: 14/082,661

(22) Filed: Nov. 18, 2013

(65) Prior Publication Data

US 2015/0140356 A1 May 21, 2015

(51) Int. Cl.

| | |
|---|---|
| ***F01D 25/00*** | (2006.01) |
| ***C23C 28/00*** | (2006.01) |
| ***F01D 5/28*** | (2006.01) |
| ***C23C 4/11*** | (2016.01) |
| ***C23C 4/073*** | (2016.01) |

(52) U.S. Cl.

CPC ..... *F01D 25/005* (2013.01); *C23C 4/073* (2016.01); *C23C 4/11* (2016.01); *C23C 28/3215* (2013.01); *C23C 28/3455* (2013.01); *F01D 5/288* (2013.01); *Y10T 428/12618* (2015.01); *Y10T 428/249969* (2015.04)

(58) Field of Classification Search

CPC . C23C 28/3215; C23C 28/3455; C23C 4/073; C23C 4/11; F01D 5/288; Y10T 428/249969; Y10T 428/12618

See application file for complete search history.

(56) References Cited

U.S. PATENT DOCUMENTS 5,053,365 A 10/1991 Shore et al.
5,185,217 A 2/1993 Miyamoto et al.
(Continued)

FOREIGN PATENT DOCUMENTS

EP 1327702 A1 7/2003

OTHER PUBLICATIONS

Y. Wang and T.W. Coyle; "Solution Precursor Plasma Spray of Nickel-Yittria Stabilized Zirconia Anodes for Solid Oxide Fuel Cell Application"; Journal of Thermal Spray Technology; vol. 16(5-6) Mid-Dec. 2007; pp. 898-904.
(Continued)

*Primary Examiner* — Jonathan Langman

(57) ABSTRACT

Yttria stabilized zirconia (YSZ) particles (40) form a thermal barrier layer (58) on a metal substrate (24). The YSZ particles have a porous interior (52, 54) and a fully melted and solidified outer shell (50). The thermal barrier layer may have porosity greater than 12%, including porosity within the particles and inter-particle gap porosity. Inter-particle gaps may be greater than 5 microns. The thermal barrier layer may exhibit elastic hysteresis and an average modulus of elasticity of 15-25 GPa. A bond coat (44A, 44B) may be applied between the substrate and the thermal barrier layer. The bond coat may have a first dense MCrAlY layer (44A) on the substrate and a second rough, porous MCrAlY layer (44B) on the first MCrAlY layer, the bond layers diffusion bonded to each other and to the substrate.

19 Claims, 4 Drawing Sheets

(56) References Cited

U.S. PATENT DOCUMENTS

| | | | | |
|---|---|---|---|---|
| 5,705,231 | A | 1/1998 | Nissley et al. | |
| 6,210,812 | B1 | 4/2001 | Hasz et al. | |
| 6,294,260 | B1 | 9/2001 | Subramanian | |
| 6,447,848 | B1 | 9/2002 | Chow et al. | |
| 6,641,907 | B1 | 11/2003 | Merrill et al. | |
| 6,780,458 | B2 | 8/2004 | Seth et al. | |
| 6,977,060 | B1 * | 12/2005 | Merrill | C04B 38/08 419/5 |
| 7,648,605 | B2 | 1/2010 | Merrill et al. | |
| 8,357,454 | B2 | 1/2013 | Kulkarni et al. | |
| 2004/0106015 | A1 | 6/2004 | Damani et al. | |
| 2004/0229031 | A1 | 11/2004 | Gell et al. | |
| 2005/0164143 | A1 | 7/2005 | Holcombe et al. | |
| 2009/0258247 | A1 | 10/2009 | Kulkarni et al. | |
| 2010/0015350 | A1 | 1/2010 | Allen | |
| 2012/0202678 | A1 | 8/2012 | Lima et al. | |
| 2012/0276355 | A1 | 11/2012 | Sansom | |

OTHER PUBLICATIONS

Lima R S et al: "Nanostructured YSZ thermal barrier coatings engineered to counteract sintering effects", Materials Science and Engineering A: Structural Materials: Properties, Misrostructure & Processing, Lausanne, CH vol. 486, No. 1-2, Jun. 25, 2008, pp. 182-193 XP022618037.

Sung R. Choi et al: "Mechanical Properties/Database of Plasma-Sprayed Zr02-8wt% Y203 Thermal Barrier Coatings", International Journal of Applied Ceramic Technology vol. 1, No. 4, Oct. 2004 pp. 330-342, XP055167746.

* cited by examiner

THERMAL BARRIER COATING WITH CONTROLLED DEFECT ARCHITECTURE

FIELD OF THE INVENTION

The invention relates to thermal barrier coatings, and particularly to such coatings on surfaces in the hot gas flow path of a gas turbine engine.

BACKGROUND OF THE INVENTION

Thermal barrier coatings (TBCs) are used to provide thermal protection for components in the hot gas flow of turbine engines. In addition to low thermal conductivity, these coatings require compliance, meaning flexibility or other strain tolerance, in order to withstand stresses from cyclic thermal expansion, vibration, and particle impacts. TBCs require strong adherence to the substrate. They are commonly made of ceramic materials such as yttria stabilized zirconia (YSZ) due to the refractory properties of ceramics. However, ceramic coatings do not readily adhere to metal surfaces, so a bond coat of a material such as MCrAlY (M=metal, Cr=chromium, Al=aluminum, Y=yttrium) is commonly applied between a metal substrate and the TBC. MCrAlY resists oxidation at high temperatures, and is compatible with a metal superalloy substrate and a ceramic TBC.

The TBC may be applied at less than full density to reduce thermal conductivity. However, present TBCs can densify during service asymptotically toward full density. This is due to tight conformance of ceramic splats to each other, resulting in small between-the-splat (inter-splat) gaps, which can close by sintering during service. As the splat interfaces disappear; the TBC becomes rigid and loses its ability to resist strains that occur during thermal cycling. This leads to spalling. Unmitigated cracking occurs, which allows the hot working gas to reach the bond coat directly, reducing its life. Since the inter-splat gaps reduce thermal conductivity, as they close, conductivity increases.

Various means have been proposed to overcome this problem, including inclusion in the TBC of hollow ceramic spheres, columnar cracking of the TBC, and surface grooving to provide compliance by segmentation. However, the TBC material can still sinter over time, thus increasing its conductivity and reducing its resistance to spalling. Materials that delay phonon propagation, such as low k Gadolinium, can be used, but they are more expensive than yttria stabilized zirconia.

BRIEF DESCRIPTION OF THE DRAWINGS

The invention is explained in the following description in view of the drawings that show.

DETAILED DESCRIPTION OF THE INVENTION

The inventors devised a process that produces a thermal barrier coating having a particular architecture that provides reduced thermal conductivity, improved compliance, and long life span, all at low expense. This is done by starting with YSZ particles with within-the-particle (internal) porosity, and thermally spraying them onto a substrate using spray parameters that melt only an outer surface portion of each particle. This retains the internal porosity of the particles. It also increases inter-particle gaps by reducing the average aspect ratio of the splats compared to fully melted splats.

Figure 1:
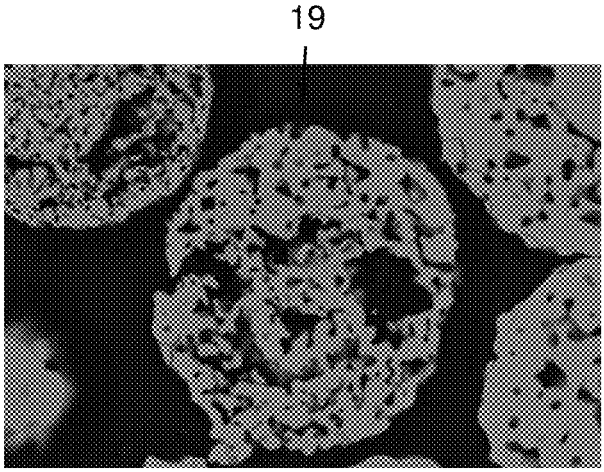
FIG 1 PRIOR ART
FIG. 1 is a photomicrograph of porous particles of yttria stabilized zirconia as known in the art.

FIG. 1 is a photomicrograph of YSZ powder formed by agglomeration and/or other process that provides particles 19 with internal porosity.

Figure 2:
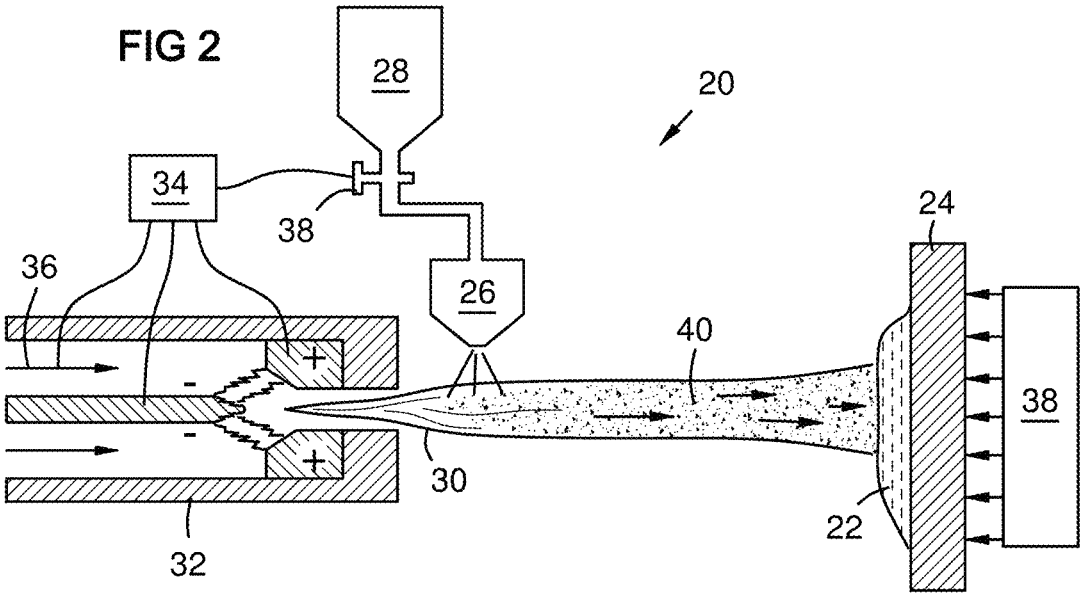
FIG. 2 is a diagram of a thermal spray system and process operating in accordance with aspects of the invention.

FIG. 2 illustrates a thermal spray system 20 for producing a ceramic thermal barrier coating 22 on a substrate 24 by injecting 26 a ceramic powder feedstock 28 such as YSZ into a thermal jet 30. A plasma gun 32 may be used to produce the thermal jet. The temperature of the substrate 24 may be controlled during the spray process by a temperature control unit 32. A spray parameter controller 34 may execute control logic, and may input user parameters, to control the spray process, including the rate and temperature of the carrier gas 36, the electric power +–, and the feedstock feed rate 38, to produce a desired thermal jet with partly melted particles 40 of the powder in accordance with aspects of the invention.

Figure 3:
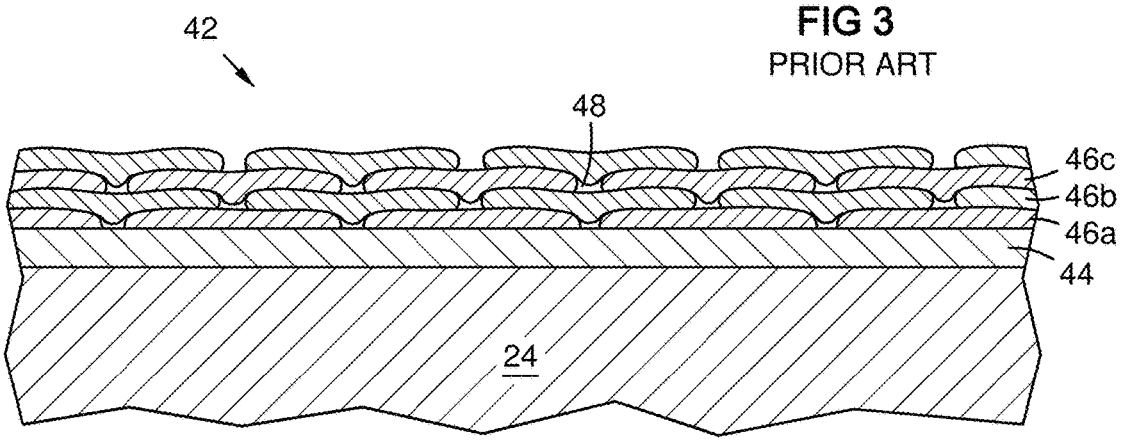
FIG 3 PRIOR ART
FIG. 3 is a conceptual sectional view of a prior art thermal barrier coating.
Figure 4:
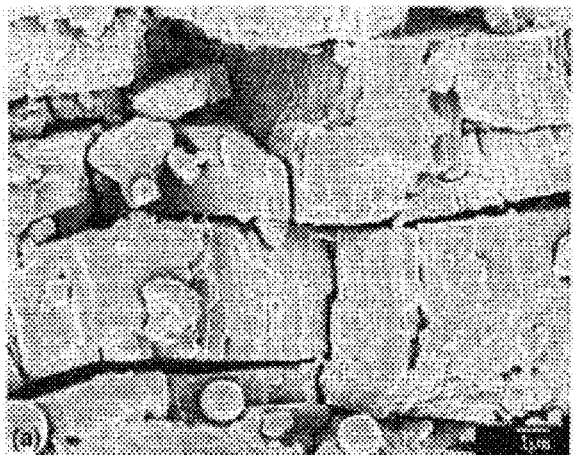
FIG 4 PRIOR ART
FIG. 4 is a sectional photomicrograph of a prior art thermal barrier coating before operational heating.
Figure 5:
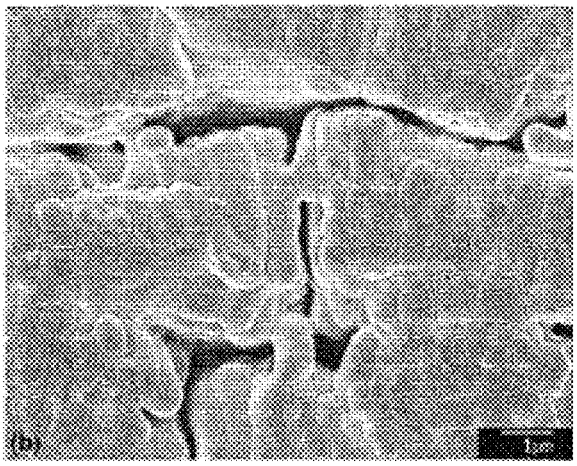
FIG 5 PRIOR ART
FIG. 5 is a sectional photomicrograph of a prior art thermal barrier coating after heating to 1400° C. for 10 hours.

FIG. 3 conceptually illustrates a prior art thermal barrier coating 42 on a substrate 24. A bond coat 44 such as MCrAlY is applied to the substrate, and then a coating of ceramic such as YSZ is applied by thermal spray. This melts the ceramic particles and impacts them on the substrate, forming relatively thin splats 46*a-c* that highly conform to previous splats with high coherence of adjacent splats, high internal density of each splat, and small inter-splat gaps 48. FIG. 4 is a photomicrograph of a conventional YSZ TBC sprayed with full melting of the YSZ particles by the thermal spray. Gaps between splats are commonly 1 micron or less. FIG. 5 is a photomicrograph of the TBC of FIG. 4 after 10 hours at 1400° C., showing merging and densifying due to sintering at operating temperature levels.

Figure 6:
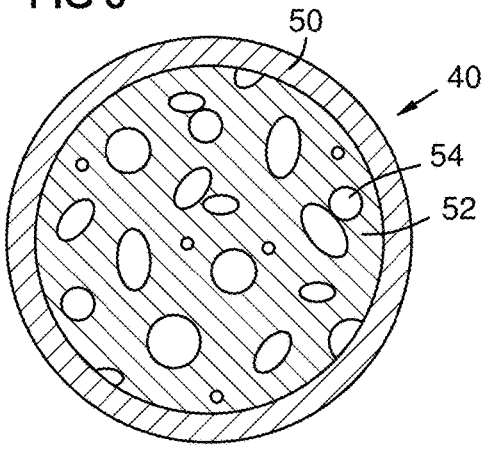
FIG. 6 is a sectional view of a porous particle with a solid shell showing aspects of an embodiment of the invention.

FIG. 6 illustrates a ceramic particle 40 in the thermal spray 30 of FIG. 2 showing aspects of an embodiment of the invention. The spray parameters are selected to melt only an outer layer or shell 50 of the particle, leaving an interior portion 52 unmelted and porous 54. The particle 40 may be 10-50% melted, or especially 10-25% melted by volume after melting. To achieve limited peripheral melting, a control methodology based on energy density in the thermal spray is useful. YSZ powders from different vendors, and in different batches from the same vendor, can vary in substantially in mass density and other properties. However, the inventors found that the melt percentage is a linear function of energy density, which may be expressed as watts per liter of carrier gas flow for a given powder mass feed rate in the thermal spray process. To adjust for a new batch of powder, test spraying may be done into a collection tank with small sample of the powder using an energy density such as 500 watts per liter. The collected particles may then be evaluated for melt percentage, and the energy density may be adjusted if needed. This results in at least most of the spray particles, or especially over 80% of them, having the desired melting percentage, with the outer shell 50 being essentially non-porous, meaning it has greater than 95% of theoretical density, and the interior portion being porous, meaning it has less than 90% of theoretical density.

The melt percentage may be evaluated using Archimedes' Principle to find the powder density before and after test spraying, calculating the resulting densification percentage, and converting this to the melt percentage. Alternately, the melt percentage may be evaluated graphically in sectional photomicrographs of a sample of the test-sprayed particles.

Figure 7:
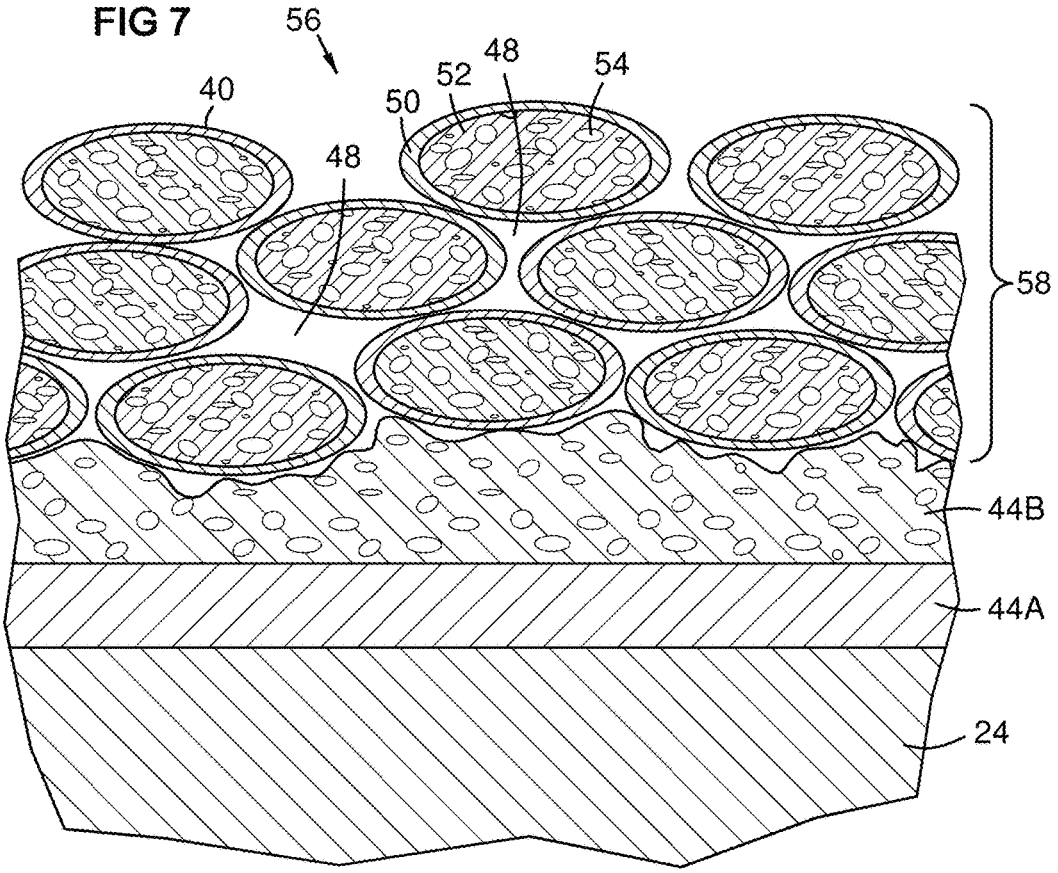
FIG. 7 is a conceptual sectional view of a thermal barrier coating system showing aspects of an embodiment of the invention.

FIG. 7 illustrates a thermal barrier coating system 56 on a substrate 24 showing aspects of an embodiment of the invention. A bond coat system 44A-B of a material such as MCrAlY may be applied in two layers, the first layer 44A being highly dense, for example having a mass density of at least 95%, and the second layer 44B being rougher and less dense. For example, layer 44A may be applied by a high velocity oxy-fuel process, and layer 44B may be applied by air plasma spray as a rough flash coat. After application, the bond coat system 44A-B may be heat-treated sufficiently for diffusion bonding of the two layers 44A, 44B to each other and to the substrate 24.

A thermal barrier layer 58 is formed on the rough bond coat 44B by a thermal spray process such as air plasma spray. Controlled melting renders the particles 40 partly malleable. The force of impact may cause some flattening, but the particles 40 do not conform to each other as closely, or cohere as completely, as fully melted splats. The particles may have an average aspect ratio in a range of 1-4, for example. This leaves larger inter-particle gaps 48, which may have an average gap dimension (such as gap width) greater than 5 microns or especially 10-40 microns or 20-30 microns. This contrasts with prior art gaps averaging 1 micron or less. The thermal barrier layer 58 may have a porosity of greater than 12% or especially 14-17%, including porosity 54 in the particles thereof and the inter-particle gaps 48. The particles have less contact area and coherence than prior art, which allows more relative motion among them, including sliding among some surfaces of some of the particles. This combination of micro-structural features in the coating system 56 provides low thermal conductivity; increased compliance, including increased elasticity; minimal sintering; mitigation of crack propagation; and negligible or reduced spalling compared to prior art.

Figure 8:
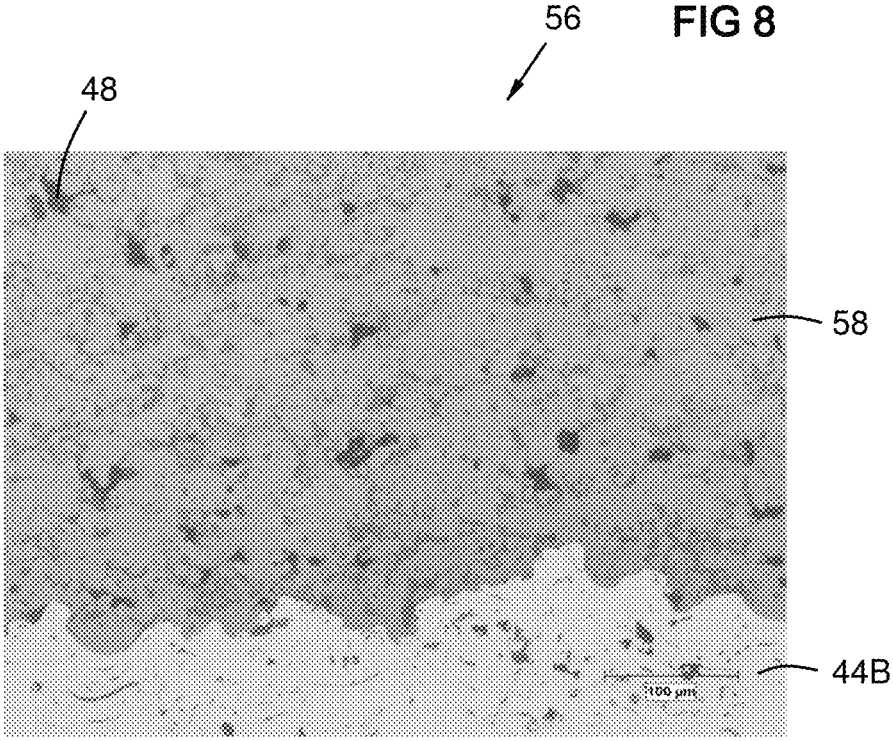
FIG. 8 is a sectional photomicrograph of a thermal barrier coating system showing aspects of an embodiment of the invention.

FIG. 8 is a photomicrograph of a thermal barrier coating system 56 showing aspects of an embodiment of the invention, including a rough bond coat layer 44B, and a thermal barrier layer 58 with controlled defects including inter-splat gaps 48.

Figure 9:
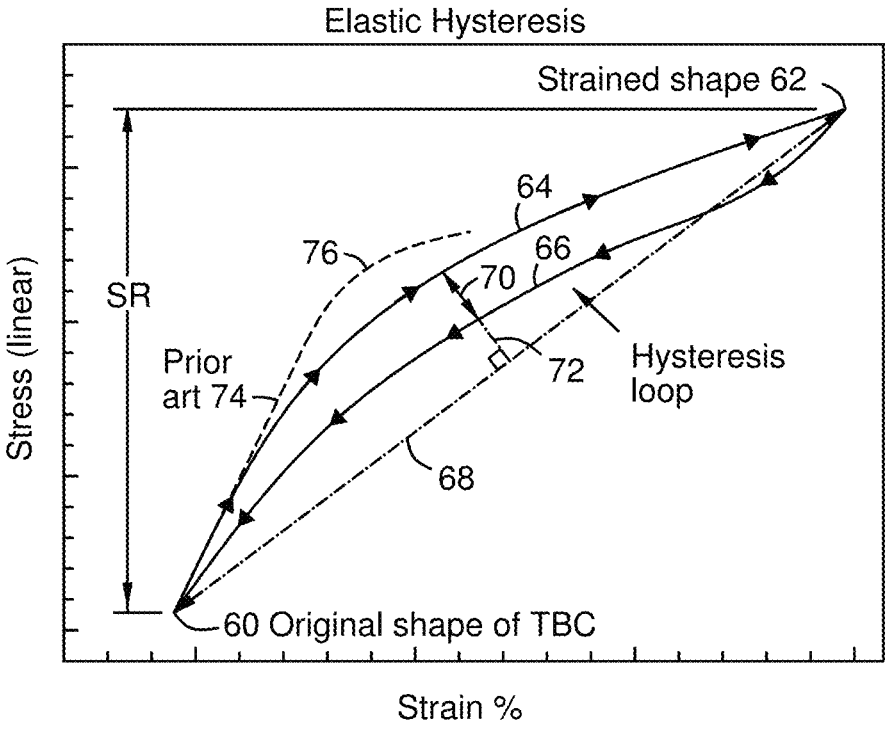
FIG. 9 is a stress/strain graph from tests of an embodiment of the invention, showing elastic hysteresis of the invented thermal barrier coating compared to prior art.

FIG. 9 shows an elastic hysteresis loop exhibited by a thermal barrier system in an embodiment of the invention as drawn on a stress/strain graph with linear/linear units. Within a given stress range SR, the thermal barrier starts at a beginning shape 60 and reaches a relatively distorted shape 62 along a first stress/strain curve 64. Upon removal of the stress, the thermal barrier returns to its beginning shape along a different stress/strain curve 66. A prior art TBC with fully melted splats and operational sintering follows a stress strain curve with a limited linear elastic portion 74 followed by a non-linear plastic portion 76 ending in spalling. The modulus of elasticity of such prior art is commonly over 30 GPa. In contrast, the overall modulus of elasticity of the present TBC after operational service may be in a range of about 15-25 GPa or especially 16-20 GPa, based on line 68.

A magnitude of hysteresis is defined herein as the separation 70 between the two stress/strain curves 64, 66 divided by the distance 68 between the beginning and ending points 60, 62. A more detailed description is as follows: The thermal barrier layer exhibits elastic hysteresis on a stress/strain graph with linear/linear units, wherein first 64 and second 66 stress/strain curves each span between a beginning point 60 on the graph and an ending point 62 on the graph, forming a hysteresis loop 64, 66, wherein the distance 70 between the two stress/strain curves divided by the distance 68 between the beginning and ending points 60, 62 gives a hysteresis magnitude in a range of 0.05-0.10, wherein the distance between the two stress/strain curves is taken along a perpendicular 72 drawn from a midpoint of a line 68 between the beginning and ending points 60, 62.

Elastic hysteresis of the invented thermal barrier layer appears to be caused by a proportion of slidable ceramic particles in the TBC retained by a 3D web of coherency chains among other particles. The slidable particles may have partial or no coherence to adjacent particles. The 3D web distorts elastically under stress, allowing non-coherent surfaces of the some particles, to slide against other particles, creating frictional heat, and thus producing the hysteresis loop. It takes more work to slide a particle out of its spray-nested position than to slide it back into that position. Each particle has a relatively thin, dense shell that can elastically distort slightly in a motion. The thinness of the shell enhances its elasticity. The porous interior of the particle fractures into a mobile filler that keeps the particle inflated, but is not rigid.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A thermal barrier coating system comprising:

a bond coat on a substrate;

a plurality of ceramic particles forming a thermal barrier layer on the bond coat, wherein the ceramic particles comprise a porous interior portion and a non-porous outer shell;

wherein the outer shell of at least most of the particles in the thermal barrier layer comprises 10-50% by volume of the particle; wherein the thermal barrier layer exhibits elastic hysteresis on a stress/strain graph with linear/linear units, wherein first and second stress/strain curves each span between a beginning point on the graph and an ending point on the graph, forming a hysteresis loop, and wherein a distance between the two stress/strain curves divided by a distance between the beginning and ending points gives a hysteresis magnitude in a range of 0.05-0.10, wherein the distance between the two stress/strain curves is taken along a perpendicular drawn from a midpoint of a line between the beginning and ending points.

2. The thermal barrier coating of claim 1, wherein in at least 80% of the particles the outer shell comprises 10-50% by volume of the particle.

3. The thermal barrier coating of claim 1, wherein in at least 80% of the particles the outer shell comprises 10-25% by volume of the particle, and have an aspect ratio in a range of 1-4.

4. The thermal barrier coating of claim 1, wherein the thermal barrier layer has a porosity greater than 12%, including a porosity within the particles of the plurality and an inter-particle porosity in the thermal barrier layer.

5. The thermal barrier coating system of claim 1, wherein the thermal barrier layer exhibits elastic hysteresis and an average modulus of elasticity of 15-25 GPa.

6. The thermal barrier coating system of claim 1, wherein the thermal barrier layer comprises an average inter-particle gap width of greater than 5 microns.

7. The thermal barrier coating system of claim 1, wherein the bond coat comprises a first MCrAlY layer on the substrate, and a second MCrAlY layer on the first MCrAlY layer, wherein the second MCrAlY layer has a lower density and a higher roughness than the first MCrAlY layer, and the first and second MCrAlY layers are diffusion bonded to each other and to the substrate.

8. A thermal barrier coating system comprising:

a plurality of yttria stabilized zirconia (YSZ) particles forming a thermal barrier layer on a substrate, wherein at least 80% of the YSZ particles comprise a porous interior portion and a fully melted and solidified outer shell;

wherein for said at least 80% of the particles, the outer shell comprises 10-50% by volume of the particle, and an average particle has an aspect ratio in a range of 1-4;

wherein the thermal barrier layer has a porosity greater than 12%, including a porosity within the particles thereof and an inter-particle porosity thereof; and wherein the thermal barrier layer exhibits elastic hysteresis over an average modulus of elasticity of 15-25 GPa.

9. The thermal barrier coating system of claim 8, further comprising a bond coat between the substrate and the thermal barrier layer, wherein the bond coat comprises a first MCrAlY layer on the substrate, and a second MCrAlY layer on the first MCrAlY layer, wherein the second MCrAlY layer has a lower density and a higher surface roughness than the first MCrAlY layer, and the first and second MCrAlY layers are diffusion bonded to each other and to the substrate.

10. The thermal barrier coating system of claim 8, wherein the thermal barrier layer comprises elastic hysteresis over a given stress range, and comprises an average modulus of elasticity of 16-20 GPa over the given stress range.

11. The thermal barrier coating system of claim 8, wherein the thermal barrier layer comprises an average inter-particle gap width of 20-30 microns.

12. The thermal barrier coating of claim 8 wherein the thermal barrier layer exhibits elastic hysteresis on a stress/strain graph with linear/linear units, wherein first and second stress/strain curves each span between a beginning point on the graph and an ending point on the graph, forming a hysteresis loop, and wherein a distance between the two stress/strain curves divided by a distance between the beginning and ending points gives a hysteresis magnitude in a range of 0.05-0.10, wherein the distance between the two stress/strain curves is taken along a perpendicular drawn from a midpoint of a line between the beginning and ending point.

13. The thermal barrier coating system of claim 8, wherein the thermal barrier layer comprises a porosity of 15-17%, including a porosity within the particles thereof and an inter-particle gap porosity thereof.

14. A thermal barrier coating system comprising:

a plurality of ceramic particles forming a thermal barrier layer on a metal substrate, wherein at least 80% of the particles comprise a porous interior portion with less than 90% of theoretical density and a non-porous outer shell with greater than 95% of theoretical density;

wherein for said at least 80% of the particles, the outer shell comprises 10-25% by volume of the particle, and an average particle has an aspect ratio in a range of 1-4;

wherein the thermal barrier layer has a porosity greater than 12%, including a porosity within the particles thereof and an inter-particle gap porosity thereof; and wherein the thermal barrier layer exhibits elastic hysteresis over a given stress range and average modulus of elasticity of 15-25 GPa over the given stress range.

15. The thermal barrier coating system of claim 14, further comprising a bond coat between the substrate and the thermal barrier layer, wherein the bond coat comprises a first MCrAlY layer on the substrate, and a second MCrAlY layer on the first MCrAlY layer, wherein the second MCrAlY layer has a lower density and a higher surface roughness than the first MCrAlY layer, and the first and second MCrAlY layers are diffusion bonded to each other and to the substrate.

16. The thermal barrier coating system of claim 14, wherein the thermal barrier layer exhibits an elastic hysteresis over a given stress range, and an average modulus of elasticity of 16-20 GPa over the given stress range.

17. The thermal barrier coating system of claim 14, wherein the thermal barrier layer comprises an average inter-particle gap width of 20-30 microns.

18. The thermal barrier coating of claim 14 wherein the thermal barrier layer exhibits an elastic hysteresis on a stress/strain graph with linear/linear units, wherein first and second stress/strain curves each span between a beginning point on the graph and an ending point on the graph, forming a hysteresis loop, and wherein a distance between the two stress/strain curves divided by a distance between the beginning and ending points gives a hysteresis magnitude in a range of 0.05-0.10, wherein the distance between the two stress/strain curves is taken along a perpendicular drawn from a midpoint of a line between the beginning and ending points.

19. The thermal barrier coating system of claim 14, wherein the thermal barrier layer comprises a porosity of 15-17%, including a porosity within the particles thereof and an inter-particle porosity thereof.

* * * * *